US005257804A

United States Patent [19]

Dieuloufet et al.

[11] Patent Number: 5,257,804

[45] Date of Patent: Nov. 2, 1993

[54] DEVICE FOR IGNITING A BED OF A MIXTURE OF MATERIALS SUCH AS ORE AND COKE

[75] Inventors: Jean-Claude Dieuloufet, Raphele-les-Arles; Gérard Griffay, Aix en Provence, both of France

[73] Assignee: Sollac, Puteaux, France

[21] Appl. No.: 805,682

[22] Filed: Dec. 12, 1991

[30] Foreign Application Priority Data

Dec. 20, 1990 [FR] France ..... 90 16034

[51] Int. Cl.[5] ..... C21B 4/16

[52] U.S. Cl. ..... 266/177; 266/176

[58] Field of Search ..... 266/177, 178, 176

[56] References Cited

U.S. PATENT DOCUMENTS 3,779,077 12/1973 Barry et al. ..... 73/341

FOREIGN PATENT DOCUMENTS 0036609 9/1981 European Pat. Off. .
0126948 12/1984 European Pat. Off. .
0221797 5/1987 European Pat. Off. .
0482875 5/1917 France .
1274487 9/1961 France .
1397409 3/1965 France .
2347445 11/1977 France .

*Primary Examiner*—Scott Kastler
*Attorney, Agent, or Firm*—Oblon, Spivak, McClelland, Maier & Neustadt

[57] ABSTRACT

Device (10) for igniting a moving bed of a mixture (12), in particular a mixture comprising iron ore and coke the combustion of which produces the agglomeration of the ore. The device comprises a hood (14) under which burners (16) are arranged and through which the mixture bed (12) travels. The burners (16) have axes oriented in directions substantially perpendicular to the surface of the mixture bed (12) and each burner (16) has a gas flow and an air flow which are individually adjustable, the burners being of the high-speed gas ejection type.

5 Claims, 1 Drawing Sheet

DEVICE FOR IGNITING A BED OF A MIXTURE OF MATERIALS SUCH AS ORE AND COKE

The present invention relates to a device for igniting a moving bed of a mixture, in particular a mixture comprising ore and coke the combustion of which produces the agglomeration of the ore.

The procedure for transforming the ore in the iron industry comprises in particular a step for agglomerating the iron ore which principally consists in the pre-firing of the latter before it is charged into a blast furnace.

This pre-firing is achieved by combustion of a mixture containing principally the ore and the coke.

The mixture, generally disposed in a bed, is driven along to a crusher and then to the blast furnace.

The reaction of the combustion of the mixture is sufficiently exothermic so that when it is initiated upon the ignition of the mixture it maintains itself provided there is an adapted supply of oxygen.

An ignition device, generally termed ignition hood, is placed on the upstream side of the ignition line and initiates the combustion reaction on the surface of the bed of the mixture. The combustion is then propagated through the thickness of the mixture bed as the latter travels along so that the complete agglomeration of the ore is accomplished before it reaches the crusher.

It is known to employ an ignition hood under which burners are disposed on each side of the lateral edges of the mixture bed so as to eject their products of combustion in a horizontal direction, i.e. parallel to the surface of the mixture bed so that the flames lick the surface of the latter.

The ignition hood heats the mixture bed by radiation from the walls throughout its width and, as the mixture bed passes therethrough, the surface of the mixture bed gradually reaches the combustion temperature.

However, as a burner flame does not have a homogeneous temperature throughout its length and as two burner flames disposed in confronting relation on each side of the mixture bed overlap at the centre of the bed, the temperature of the surface of the latter is heterogeneous in the direction of its width.

Further, possible irregularities in the thickness of the mixture bed also result in a poor distribution of the temperature over the surface of the mixture bed.

The ignition is accelerated and the propagation of the combustion reaction is achieved by causing the air to circulate in a direction perpendicular to the surface of the mixture bed, the oxygen of the air in this way feeding the combustion reaction.

As the ignition device ensures in particular the evaporation of the water of the mixture, spaces are created in the mixture which allow the circulation of the air.

An excessively high temperature of the mixture causes its vitrifaction and loss of its permeability to air, which prevents this circulation of air. On the other hand, an excessively low temperature of the mixture does not permit the agglomeration of the ore. It is therefore important to obtain a homogeneous and well-controlled temperature in a defined thickness, which is not achieved by the known device.

Further, the circulation of the hot gases which is in a direction perpendicular to the surface of the mixture bed is in opposition to the movement of the ejection of the gases from the burners which occurs in a direction parallel to the surface of the mixture bed. Consequently, the gas flows from the burners through the mixture are heterogeneous.

Lastly, as the flames of the burners are horizontal relative to the surface of the mixture bed, they unnecessarily heat the inner surface of the hood located thereabove and in this way increase the heat losses.

In order to overcome in particular the drawbacks of heterogeneity of the temperature in the direction of the width of the mixture bed, disparity in the circulation of the gas flows and in particular in the distribution of oxygen and heat losses, the invention proposes a device for igniting a moving bed of a mixture, in particular a mixture comprising iron ore and coke the combustion of which produces the agglomeration of the ore, of the type comprising a hood under which are disposed burners fed with fuel and air, the hood extending over the mixture bed throughout its width and on a length adapted to heat the latter up to the ignition temperature, the burners having axes oriented in a direction substantially perpendicular to the surface of the mixture bed, characterized in that the fuel flow and the air flow are separately and individually adjustable for each burner.

According to other features of the invention:

the burners are disposed in at least one row extending in the direction of the width of the mixture bed;

each row of burners is spaced away from the following row by at the most one meter;

each row has at least two burners per meter of the width of the mixture bed;

the fuel of the burners is gas;

the burners are of the high-speed gas ejection type.

BRIEF DESCRIPTION OF THE DRAWINGS

The following description will reveal other features and advantages of the invention. This description refers to the accompanying drawing in which:

FIG. 1 shows an ignition device 10 for igniting a bed of a mixture 12 which travels in the direction indicated by the arrows $F_1$ and carried by a conveyor 13.

Figure 1:
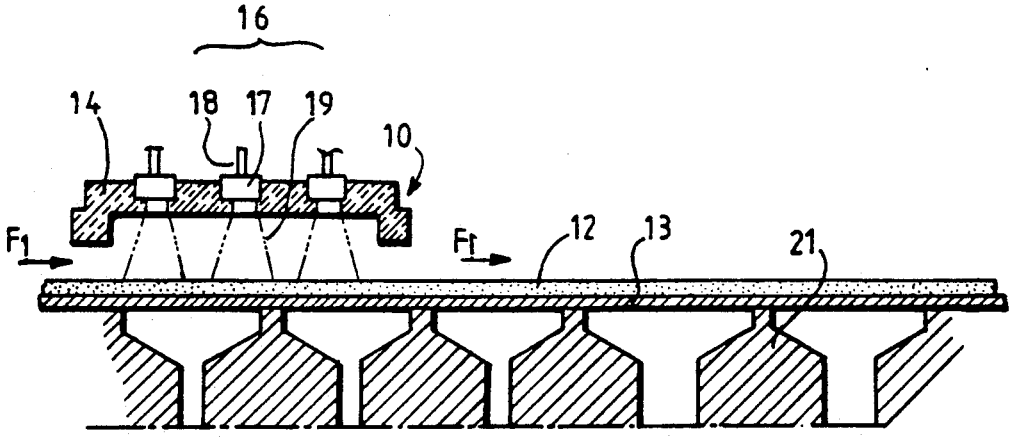
FIG. 1 is a diagrammatic longitudinal sectional view of an ignition device according to the invention.

The mixture comprises principally iron ore, coke the combustion of which affords the heat energy required for agglomerating the ore, water and lime.

The mixture bed 12 has for example a width of 5 meters, a thickness of 0.5 to 0.7 meters and a length of 80 meters between the ignition device 10 and the crusher, in relation with the time of propagation of the combustion reaction through the thickness of the mixture.

The ignition device 10 comprises a hood 14. The latter comprises at least one row of burners 16 whose axes are oriented in directions substantially perpendicular to the surface of the mixture bed 12.

Each burner 16 comprises a body 17, a gas supply pipe 18 and an air supply pipe not shown in the drawing for reasons of clarity. A cone of the ejection of the hot gases 19 is diagrammatically represented by two dot-dash lines under each burner body.

In the illustrated embodiment, these burners 16 are arranged in alignment in three rows spaced equal distances apart of at the most one meter and extending throughout the width of the mixture bed 12, one burner per row being shown.

Preferably, burners having a high-speed ejection of the gases, i.e. higher than 80 m/s, are used.

The burners named JET having a chambered flame sold by the firm AUBURTIN having a power of 300 th/h per burner correspond to this characteristic and may be employed in the device according to the invention.

In the illustrated embodiment, each row of burners comprises twenty burners of the aforementioned type so that there are in all sixty burners arranged under the hood.

For a mixture bed 12 having the aforementioned dimensions, the actuation of a single row of burners 16 is sufficient to obtain the ignition of the bed.

The hood 14 is made for example from a refractory material.

The ignition device 10 and the mixture bed 12 are carried by a masonry structure 21.

Figure 2:
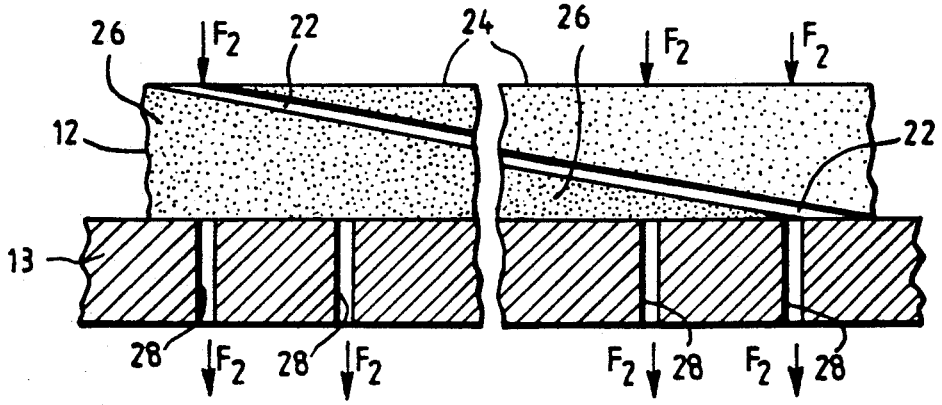
FIG. 2 is a diagrammatic longitudinal sectional view to an enlarged scale of a mixture bed through which the combustion reaction is propagated.

FIG. 2 illustrates how the combustion reaction, initiated by the ignition device 10 on the surface of the mixture bed 12, is propagated through the thickness of the latter as it moves toward the crusher.

Three zones are defined in the mixture bed 12. A first zone 22 corresponds to the part of the mixture in combustion, a second zone 24 corresponds to the agglomerated mass of ore obtained after the combustion of the mixture, and a third zone 26 corresponds to the mixture which has not yet reacted.

Slots 28 are provided in the conveyor 13 throughout the length where the combustion reaction is propagated and put the mixture bed in communication with an air suction device of known type (not shown) which produces a draught effect causing the air to circulate in the directions of the arrows $F_2$ shown in FIG. 2. This air, which circulates through the thickness of the bed 12, provides the oxygen required to maintain the combustion reaction of the mixture.

The left part of FIG. 2 shows the start of the propagation of the combustion reaction which was initiated on the surface of the mixture bed 12, at the outlet of the ignition device.

The right part of FIG. 2 shows that the combustion reaction has reached the lower side of the mixture bed and that the mixture has been converted into an agglomerated ore for feeding to the blast furnace.

For a mixture of the aforementioned type, the combustion occurs in an optimum manner, for example, for a temperature between 1,100° C. and 1,250° C.

The obtainment of a temperature which is homogeneous throughout a band corresponding to the width of the mixture bed 12 is indispensable to a good propagation of this combustion reaction through the thickness of the mixture at the outlet of the ignition device 12.

The device according the invention permits in particular mastering the homogeneity of the ignition temperature in such a band.

Indeed, the fuel gas flow and the comburent gas (air) flow are adjustable separately and individually for each burner 16, by known regulating means usually employed (not shown). Further, each burner heats essentially a sector of the surface of the mixture bed 12 defined by the ejection cone of its gases and the assembly of the burners heats as many sectors as required for bringing the mixture to its ignition temperature throughout the width of the bed.

The individual adjustment of the flow of the gases of each burner 16 permits controlling the temperature sector by sector and therefore permits providing a relatively homogeneous temperature over the surface of the mixture bed 12.

It also permits obtaining a temperature of the upper surface of the mixture of between 1,100° C. and 1,250° C. for a mixture thickness of between 0.4 and 0.7 m.

It also permits adjusting the supply of oxygen for the combustion of the coke.

Further, this possibility of an individual adjustment permits adapting the heating to a mixture bed whose cross-section has a variable thickness, for example in the case of a V-shaped section such that the mixture bed is thicker at the centre than on its edges, or inversely.

The ejection of the products of combustion and the circulation of the hot gases through the mixture bed occur in the same direction so that there is consequently no disturbance and the consumption of oxygen and gas by the burners is thereby optimised. In this way there is ensured a homogeneous temperature of the gases entering the mixture bed.

Further, by the use of burners 16 of the high-speed gas ejection type, there is an improved mastering of the heat and gaseous flows owing to the rapid ejection of the gases which causes the recirculation of the smoke and the constitution of a homogeneous hot zone under the hood.

As the ejection of the gases occurs from the top of the hood 14 toward the surface of the mixture bed 12, the heat losses through the wall of the hood 14 are less than in the case of a horizontal arrangement of the burners which results in an unnecessary heating of the hood.

The improved mastering of the heat and gaseous flows provided by the ignition device according to the invention permits reducing the length of the hood in a proportion which may be as much as and even exceed 50%. Indeed, the mixture bed is ignited more rapidly in the case of a device according to the invention than in the case of the known device described hereinbefore, for a given rate of travel of the mixture bed.

What is claimed is:

1. Device for igniting a moving bed of a mixture, comprising iron ore and coke the combustion of which produces an agglomeration of said ore, said device comprising a hood, burners disposed under said hood, means for supplying fuel and means for supplying air to each of said burners, said hood extending over said mixture bed throughout the width of said mixture bed and on a length adapted to heat said mixture bed up to an ignition temperature, said burners having axes which are oriented in directions substantially perpendicular to the surface of said mixture bed, and means for separately and individually adjusting the fuel flow and the air flow for each of said burners.

2. Device according to claim 1, wherein said burners are arranged in at least one row extending in the direction of the width of said mixture bed.

3. Device according to claim 2, wherein said burners are arranged in a plurity of rows, each row of burners being spaced from the adjacent row by at the most one meter.

4. Device according to claim 2, wherein said at least one row comprises at least two burners per meter of the width of said mixture bed.

5. Device according to claim 3, wherein each row comprises at least two burners per meter of the width of said mixture bed.

* * * * *